US009306351B2

(12) United States Patent
Huang et al.

(10) Patent No.: US 9,306,351 B2
(45) Date of Patent: Apr. 5, 2016

(54) POWER DISTRIBUTION CONNECTION APPARATUS

(71) Applicant: Huawei Technologies Co., Ltd., Shenzhen (CN)

(72) Inventors: Xianliang Huang, Nanning (CN); Jianye Zhang, Shenzhen (CN); Fujian Qi, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/580,913

(22) Filed: Dec. 23, 2014

(65) Prior Publication Data

US 2015/0236461 A1 Aug. 20, 2015

Related U.S. Application Data

(63) Continuation of application No. PCT/CN2014/083301, filed on Jul. 30, 2014.

(30) Foreign Application Priority Data

Feb. 14, 2014 (CN) ..... 2014 1 0052475

(51) Int. Cl.
*H01R 25/00* (2006.01)
*H01R 25/14* (2006.01)
*H01H 71/08* (2006.01)

(52) U.S. Cl.
CPC ..... *H01R 25/142* (2013.01); *H01R 25/145* (2013.01); *H01H 71/08* (2013.01)

(58) Field of Classification Search
CPC .... H01R 25/14; H01R 25/142; H01R 25/145; H01R 25/162; F21V 21/34
USPC ..... 439/115, 213
See application file for complete search history.

(56) References Cited

U.S. PATENT DOCUMENTS 2,122,298 A * 6/1938 Scott, Jr. ..... H02G 5/025 174/129 B
3,459,876 A * 8/1969 Turgeon ..... H02G 5/066 174/149 B (Continued)

FOREIGN PATENT DOCUMENTS

CN 202268606 U 6/2012
CN 103779747 A 5/2014

(Continued)

OTHER PUBLICATIONS

Partial English Translation and Abstract of Chinese Patent Application No. CN103779747A, Feb. 5, 2015, 2 pages.

(Continued)

*Primary Examiner* — Abdullah Riyami
*Assistant Examiner* — Vladimir Imas
(74) *Attorney, Agent, or Firm* — Conley Rose, P.C.; Grant Rodolph; Nicholas K. Beaulieu

(57) ABSTRACT

A power distribution connection apparatus comprises a busbar that includes a first frame body and a second frame body, where one end of the first frame body is connected to one end of the second frame body; a fastener that includes a fastening part and a first connecting part, where the fastening part is fitted outside the first frame body or the second frame body, and slides along the first frame body or the second frame body, there is a tooth needle mounting hole on the first connecting part, and the first connecting part and the fastening part are connected on one side of the first frame body or the second frame body; and a tooth needle, where one end of the tooth needle is plugged inside the tooth needle mounting hole, and the plugging depth is adjustable.

18 Claims, 3 Drawing Sheets

(56) References Cited

U.S. PATENT DOCUMENTS

| | | | | | |
|---|---|---|---|---|---|
| 3,524,050 | A * | 8/1970 | Gustine | F21V 21/34 | 191/48 |
| 4,631,634 | A * | 12/1986 | Raabe | H02B 1/42 | 16/390 |
| 4,679,120 | A * | 7/1987 | Raabe | H02B 1/42 | 361/647 |
| 5,351,165 | A * | 9/1994 | Hancock | H02B 1/20 | 174/68.2 |
| 5,619,014 | A * | 4/1997 | Faulkner | H02G 5/007 | 174/129 B |
| 5,760,339 | A * | 6/1998 | Faulkner | H01R 25/162 | 174/88 B |
| 5,876,224 | A * | 3/1999 | Chadbourne | H01R 25/142 | 439/110 |
| 6,142,807 | A * | 11/2000 | Faulkner | H02G 5/08 | 174/68.2 |
| 6,296,498 | B1 * | 10/2001 | Ross | H01R 25/145 | 439/115 |
| 6,521,837 | B2 * | 2/2003 | Hilgert | H02G 3/0608 | 174/149 B |
| 6,560,123 | B1 * | 5/2003 | de Varennes | H01H 73/08 | 174/208 |
| 7,414,828 | B2 * | 8/2008 | Birner | H02B 1/056 | 174/68.2 |
| 7,468,488 | B1 * | 12/2008 | Hilgert | H02G 3/0418 | 174/101 |
| 7,470,861 | B1 * | 12/2008 | Ross | H02G 3/0418 | 174/101 |
| 7,518,851 | B2 * | 4/2009 | Tsuchiya | H02B 11/02 | 174/72 B |
| 7,557,309 | B2 * | 7/2009 | Ross | H01R 25/142 | 174/101 |
| 7,704,083 | B1 * | 4/2010 | Cheyne | H01R 25/162 | 439/115 |
| 7,722,372 | B2 * | 5/2010 | Matsumoto | H01R 13/42 | 174/68.2 |
| 7,753,739 | B2 * | 7/2010 | Bentler | H01R 9/2491 | 439/532 |
| 7,952,026 | B2 * | 5/2011 | Ramsey | H02G 5/08 | 174/129 B |
| 8,444,431 | B1 * | 5/2013 | La Salvia | H01R 4/2408 | 439/404 |
| 8,764,494 | B2 * | 7/2014 | Joseph | H01R 4/30 | 439/709 |
| 8,847,088 | B2 * | 9/2014 | Bhathija | H01H 9/22 | 200/293 |
| 8,953,306 | B2 * | 2/2015 | Wheeler | H02B 1/20 | 174/149 B |
| 2010/0022106 | A1 * | 1/2010 | Lee | H01R 25/003 | 439/92 |

FOREIGN PATENT DOCUMENTS

| | | | |
|---|---|---|---|
| DE | 4130815 | A1 | 3/1993 |
| JP | 2003157722 | A | 5/2003 |
| WO | 2011119018 | A2 | 9/2011 |

OTHER PUBLICATIONS

Foreign Communication From a Counterpart Application, PCT Application No. PCT/CN2014/083301, International Search Report dated Nov. 19, 2014, 7 pages.

Foreign Communication From a Counterpart Application, PCT Application No. PCT/CN2014/083301, Written Opinion dated Nov. 19, 2014, 4 pages.

* cited by examiner

A

B

POWER DISTRIBUTION CONNECTION APPARATUS

CROSS-REFERENCE TO RELATED APPLICATIONS

This application is a continuation of International Application No. PCT/CN2014/083301, filed on Jul. 30, 2014, which claims priority to Chinese Patent Application No. 201410052475.5, filed on Feb. 14, 2014, both of which are hereby incorporated by reference in their entireties.

TECHNICAL FIELD

The present invention relates to the field of communications technologies, and in particular, to a power distribution connection apparatus.

BACKGROUND

In a communications system, alternating current and direct current power distribution is relatively complex generally, and a circuit breaker often needs to be used. Generally, a circuit breaker is concatenated to a circuit by connecting the circuit breaker to a busbar. The busbar refers to a connecting copper bar or aluminum bar, in an electrical cabinet in a power supply system, of a total system power switch and a switch in each shunting circuit, where insulation processing is performed on a surface of the busbar and the busbar is mainly used as a conducting wire.

Currently, a fixed and molded connecting copper bar is mostly used for a connection between a circuit breaker and a busbar. However, the fixed and molded connecting copper bar is incompatible with installation of different manufacturers' circuit breakers with different sizes, and also cannot support fast replacement of circuit breakers of different manufacturers or with different sizes at an application site.

SUMMARY

Embodiments of the present invention provide a power distribution connection apparatus, which can simply and reliably implement, at a low cost, a flexible connection between a circuit breaker of any specification and a circuit, supports movement in one or multiple directions, and can flexibly change an installation position of a circuit breaker, and therefore is suitable for an on-site fast replacement application.

According to a first aspect, an embodiment of the present invention provides a power distribution connection apparatus, where the apparatus includes a busbar including a first frame body and a second frame body, where one end of the first frame body is connected to one end of the second frame body; a fastener including a fastening part and a first connecting part, where the fastening part is fitted outside the first frame body or the second frame body, and slides along the first frame body or the second frame body; and there is a tooth needle mounting hole on the first connecting part, and the first connecting part and the fastening part are connected on one side of the first frame body or the second frame body; and a tooth needle, where one end of the tooth needle is plugged inside the tooth needle mounting hole, the plugging depth is adjustable, and a side wall of the tooth needle is in contact with a side wall of the first frame body or the second frame body to form an electrical connection between the busbar and the tooth needle; and the other end of the tooth needle is connected to an external circuit breaker to concatenate the circuit breaker to an external circuit by using the power distribution connection apparatus.

With reference to the first aspect, in a first possible implementation manner of the first aspect, the apparatus further includes a secondary busbar, where the secondary busbar includes a third frame body, and one end of the third frame body is connected to an opposite end of the one end of the first frame body or an opposite end of the one end of the second frame body.

With reference to the first possible implementation manner of the first aspect, in a second possible implementation manner of the first aspect, the apparatus further includes a splicer, where the splicer includes two contact ends and a second connecting part, the two contact ends are located at two corresponding ends of the second connecting part, and that one end of the third frame body is connected to an opposite end of the one end of the first frame body or an opposite end of the one end of the second frame body includes the other end of the first frame body and an opposite end of the one end of the third frame body, or the opposite end of the one end of the second frame body and the one end of the third frame body are respectively abutted against two sides of the second connecting part to form an electrical connection between the busbar and the secondary busbar by using the second connecting part, connection points of the first frame body and the third frame body, or the second frame body and the third frame body are separately located between the two contact ends, and the connection between the busbar and the secondary busbar is fastened by using the splicer.

With reference to the second possible implementation manner of the first aspect, in a third possible implementation manner of the first aspect, there are at least two busbars, and the busbars are connected by using the splicer.

With reference to the second or the third possible implementation manner of the first aspect, in a fourth possible implementation manner of the first aspect, the second connecting part is made of a conducting material.

With reference to any one of the first to the fourth possible implementation manners of the first aspect, in a fifth possible implementation manner of the first aspect, the secondary busbar is made of a conducting material.

With reference to any one of the first to the fifth possible implementation manners of the first aspect, in a sixth possible implementation manner of the first aspect, there are also buckles at two ends of the fastener, where the buckles are used for a fixed connection between the fastener and the busbar or between the fastener and the secondary busbar.

With reference to the first aspect, or the first, the second, the third, the fourth, the fifth, and the sixth possible implementation manners of the first aspect, in a seventh possible implementation manner of the first aspect, the busbar is made of a conducting material.

With reference to the first aspect, or the first, the second, the third, the fourth, the fifth, the sixth, and the seventh possible implementation manners of the first aspect, in an eighth possible implementation manner of the first aspect, the fastener is a captive fastener.

According to the power distribution connection apparatus provided in the embodiments of the present invention, a tooth needle can slide in different directions, and a length of the tooth needle may be changed, and therefore, the power distribution connection apparatus can flexibly change an installation position of a circuit breaker, and is suitable for an on-site fast replacement application.

The following further describes the technical solutions of embodiments of the present invention in detail with reference to accompanying drawings and embodiments.

DETAILED DESCRIPTION

Figure 1:
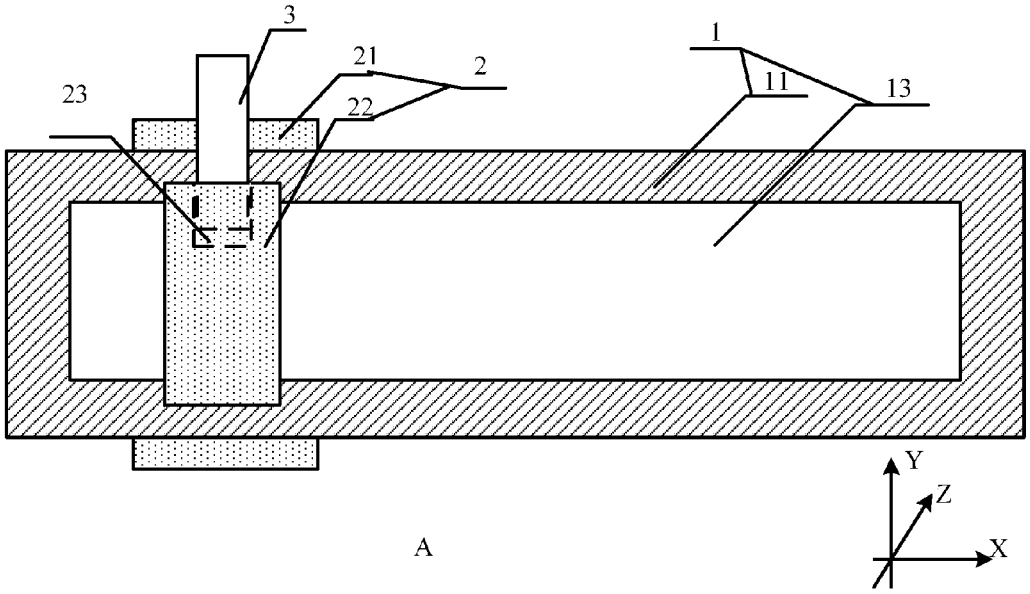
FIG. 1 is a power distribution connection apparatus according to Embodiment 1 of the present invention.
Figure 1:
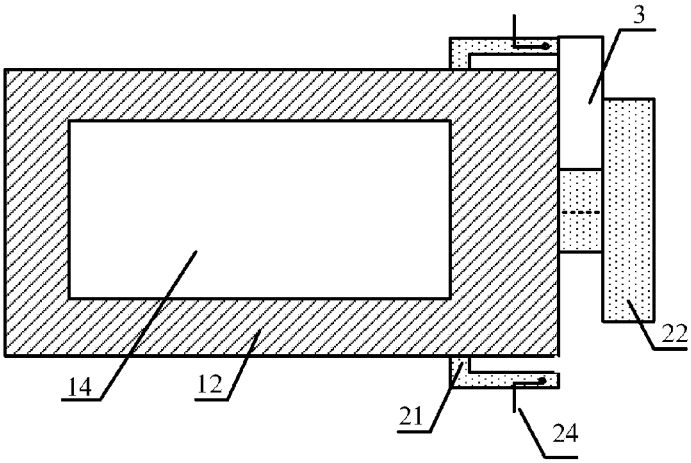

FIG. 1 is a power distribution connection apparatus according to an embodiment of the present invention. A diagram A is a main view, and a diagram B is a left view. As shown in FIG. 1, the power distribution connection apparatus includes a busbar 1, a fastener 2, and a tooth needle 3.

The busbar 1 is made of copper, aluminum or another conducting material, and includes a first frame body 11 and a second frame body 12. One end of the first frame body 11 is connected to one end of the second frame body 12 to enable the first frame body 11 to be in an integrated connection to the second frame body 12 at a certain angle. In a specific example of the present invention, the first frame body 11 is perpendicularly connected to the second frame body 12. There is a first hollow part 13 in the middle of the first frame body 11, and there is a second hollow part 14 in the middle of the second frame body 12. The first hollow part 13 and the second hollow part 14 may be holes in a strip shape as shown in FIG. 1, and may also be multiple circular holes with any spacing, or holes in another shape.

The fastener 2 includes a fastening part 21 and a first connecting part 22, where the fastening part 21 is fitted outside the first frame body 11 or the second frame body 12, and slides along the first frame body 11 or the second frame body 12, so as to drive the fastener 2 to slide along the first frame body 11 or the second frame body 12 together; the first connecting part 22 and the fastening part 21 are connected on one side of the first frame body 11 or the second frame body 12, and the first connecting part 22 passes through the first hollow part 13 or the second hollow part 14, extends to the other side of the first frame body 11 or the second frame body 12; and there is a tooth needle mounting hole 23 on the first connecting part 22.

Figure 2:
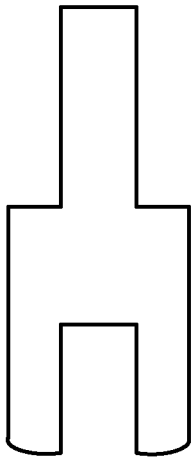
FIG. 2 is a schematic diagram of a tooth needle in a power distribution connection apparatus according to Embodiment 1 of the present invention.

Referring to the tooth needle 3, one end of the tooth needle 3 is plugged inside the tooth needle mounting hole 23, and a plugging depth for plugging into the tooth needle mounting hole 23 is adjustable; and a side wall of the tooth needle 3 is in contact with a side wall of the first frame body 11 or the second frame body 12 to form an electrical connection between the busbar 1 and the tooth needle 3. The tooth needle 3 may be made of copper, aluminum or another conducting material. The tooth needle may be in a "Y" shape as shown in FIG. 2, and may also be in a similar shape, such as an "L" shape, so that one end of the tooth needle 3 is plugged into the tooth needle mounting hole 23 and a plugging depth may be flexibly changed, and the other end of the tooth needle 3 is connected to an external circuit breaker to concatenate the circuit breaker to an external circuit by using the power distribution connection apparatus.

In an embodiment of the present invention, there are also buckles 24 at two ends of the fastener 2, where the buckles 24 are used for a fixed connection between the fastener 2 and the busbar 1 before assembly of a tooth needle.

In another embodiment of the present invention, the fastener 2 is a captive fastener, the fastening part 21 of the fastener 2 is a nut, and the first connecting part 22 is a bolt with the tooth needle mounting hole 23.

Figure 3:
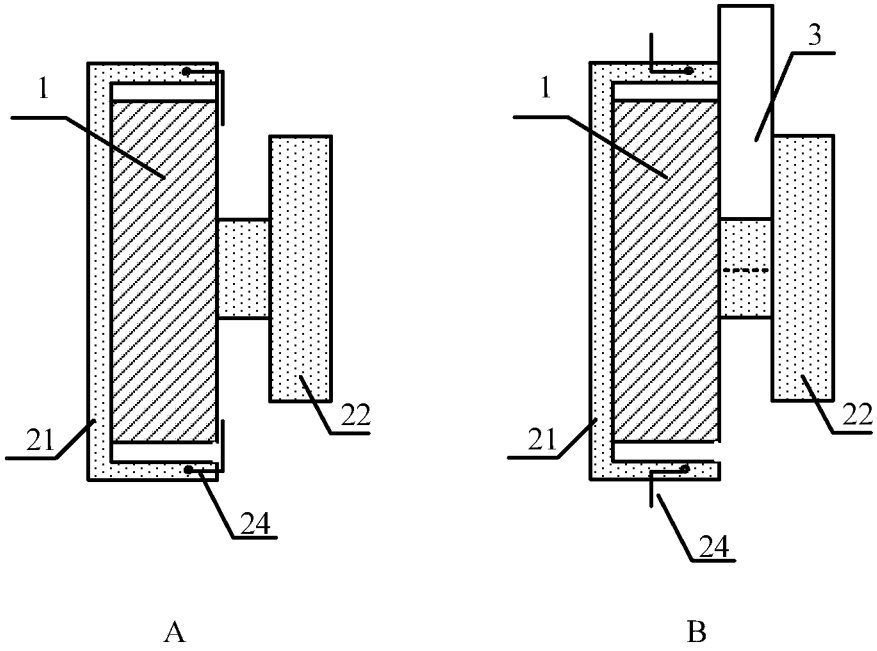
FIG. 3 is a schematic diagram of assembly of a fastener, a busbar, and a tooth needle in a power distribution connection apparatus according to Embodiment 1 of the present invention.

Assembly of the fastener 2, the busbar 1, and the tooth needle 3 is shown in FIG. 3. First, as shown in FIG. 3A, before the tooth needle 3 is plugged into the fastener 2, the buckle 24 is clasped on the busbar 1 to fasten the busbar 1 on the fastener 2. When the tooth needle 3 is to be plugged, as shown in FIG. 3B, the buckle 24 needs to be opened, and then the tooth needle 3 is plugged. A distance from the tooth needle mounting hole 23 to the first frame body 11 or the second frame body 12 may be changed by using a rotary fastening end 21 (a nut), so as to enable a side wall of one side of the tooth needle 3 to be in contact with a side wall of the first frame body 11 or the second frame body 12, so as to form an electrical connection between the busbar 1 and the tooth needle 3, and compress the tooth needle 3 plugged into the tooth needle mounting hole 23, the busbar 1, and the rotary fastening end 21 of the fastener 2 together.

When the other end of the tooth needle 3 is connected to an external circuit breaker (which is not shown in the figure), concatenation of the circuit breaker to a corresponding external circuit by using the power distribution connection apparatus in this embodiment may be implemented.

In a power distribution connection apparatus provided in a first embodiment of the present invention, the first frame body 11 and the second frame body 12 of the busbar 1 may be separately connected, by clamping, to multiple fasteners 2 and tooth needles 3, so as to connect multiple circuit breakers. Position adjustment of a circuit breaker in a Y direction may be implemented by changing a depth of the tooth needle 3, connected to the circuit breaker, in the tooth needle mounting hole 23 of the fastener 2; a position of the circuit breaker in an X direction may be changed by means of slide of the fastener 2 on the first frame body 11; and a position of the circuit breaker in a Z direction may be changed by means of slide of the fastener 2 on the second frame body 12. The X direction is a horizontal direction, the Y direction is a vertical direction, and the Z direction is an anteroposterior direction. For details, reference may be made to marks shown in the figure.

The power distribution connection apparatus provided in this embodiment of the present invention can simply and reliably implement, at a low cost, a flexible connection between a circuit breaker of any specification and a circuit, supports movement in one or multiple directions, and can flexibly change an installation position of a circuit breaker, and is suitable for an on-site fast replacement application.

Figure 4:
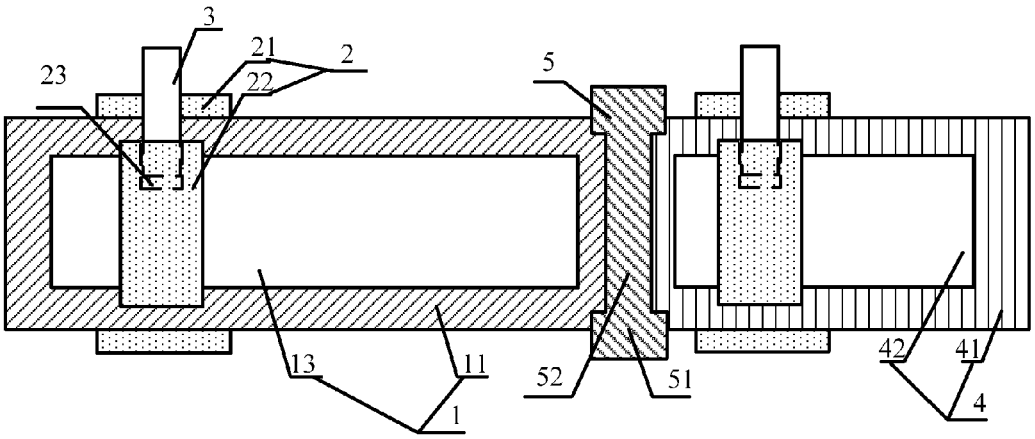
FIG. 4 is a power distribution connection apparatus according to Embodiment 2 of the present invention.

Based on the foregoing Embodiment 1, the present invention further provides a power distribution connection apparatus. As shown in FIG. 4, the power distribution connection apparatus includes the busbar 1, the fastener 2, the tooth needle 3, a secondary busbar 4, and a splicer 5.

The busbar 1, the fastener 2, and the tooth needle 3 are all the same as those described in the foregoing embodiments, and details are not repeatedly described herein.

The secondary busbar 4 is made of copper, aluminum or another conducting material, and includes a third frame body 41, where there is a third hollow part 42 in the middle of the third frame body 41. One end of the third frame body 41 is connected to an opposite end of the one end of the first frame body 11 or an opposite end of the one end of the second frame body 12.

The splicer 5 includes two contact ends 51 and a second connecting part 52, where the two contact ends 51 are connected by using the second connecting part 52. The second connecting part 52 is made of a conducting material that may be copper, aluminum or another conducting material. In an embodiment of the present invention, a surface of the splicer is covered with conductive powder or conductive metal particles. The two contact ends 51 may also be made of a same conducting material or another material.

The splicer 5 may connect the secondary busbar 4 and the busbar 1.

One end of the first frame body 11 of the busbar 1 and one end of the third frame body 41 of the secondary busbar 4, or one end of the second frame body 12 of the busbar 1 and one end of the third frame body 41 of the secondary busbar 4 are respectively abutted against two sides of the second connecting part 52 to form an electrical connection between the busbar 1 and the secondary busbar 4 by using the second connecting part 52; and connection points of the first frame body 11 and the third frame body 41, or the second frame body 12 and the third frame body 41 are separately located between the two contact ends 51, and therefore, the connection between the busbar 1 and the secondary busbar 4 is fastened by using the splicer 4.

In an embodiment of the present invention, there are at least two busbars 1, and the busbars 1 are connected by using the splicer 5.

When the other end of the tooth needle 3 is connected to an external circuit breaker (which is not shown in the figure), concatenation of the circuit breaker to an external circuit by using the power distribution connection apparatus in this embodiment may be implemented.

In a power distribution connection apparatus provided in a second embodiment, the first frame body 11 of the busbar 1 may be separately connected, by clamping, to multiple fasteners 2 and tooth needles 3, and the third frame body 41 of the secondary busbar 4 and the second frame body 12 may be separately connected, by clamping, to multiple fasteners 2 and tooth needles 3, so as to connect multiple circuit breakers. Position adjustment of a circuit breaker in a Y direction may be implemented by changing a depth of the tooth needle 3, connected to the circuit breaker, in the tooth needle mounting hole 23 of the fastener 2; a position of the circuit breaker in an X direction may be changed by means of slide of the fastener 2 on the first frame body 11 and the third frame body 41; and a position of the circuit breaker in a Z direction may be changed by means of slide of the fastener 2 on the second frame body 12. The X direction is a horizontal direction, the Y direction is a vertical direction, and the Z direction is an anteroposterior direction. For details, reference may be made to marks shown in the figure.

The power distribution connection apparatus provided in this embodiment of the present invention can simply and reliably implement, at a low cost, a flexible connection between a circuit breaker of any specification and a circuit, supports movement in one or multiple directions, and can flexibly change an installation position of a circuit breaker, and is suitable for an on-site fast replacement application.

The splicer 5 in the foregoing embodiment may also be used to interconnect at least two busbars 1 or interconnect multiple secondary busbars 4, where the splicer 5 may be used for a connection to adapt to different applications. Shapes of the busbar 1 and the secondary busbar 4 are not limited to shapes provided in the foregoing embodiment of the present invention, and exterior shape characteristics of the busbar 1 and the secondary busbar 4 may also be designed according to actual needs.

In addition, the foregoing embodiment merely provides an application in which the splicer 5 is used to connect the busbar 1 and the secondary busbar 4 in a horizontal direction. In another specific application, a structure of the splicer 5 may also be slightly changed to implement an application of a connection at another angle or a multi-end connection.

Figure 5:
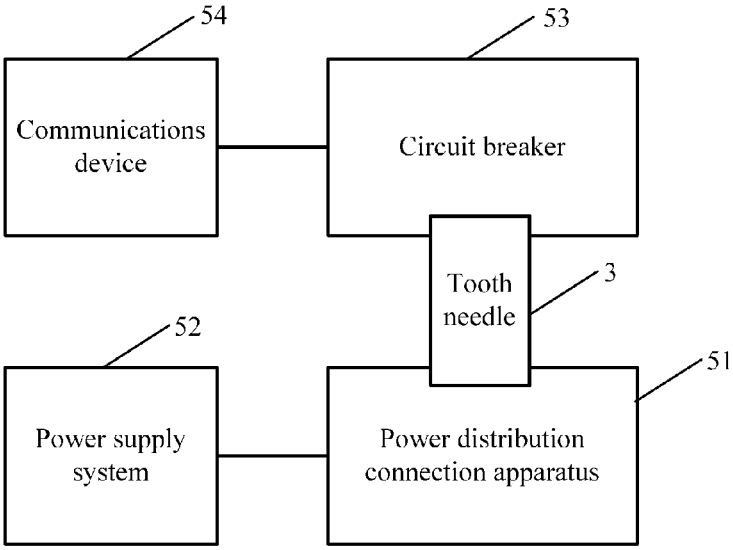
FIG. 5 is a schematic diagram of an application of a power distribution connection apparatus in a communications system according to an embodiment of the present invention.

The power distribution connection apparatus provided in the embodiments of the present invention can be applied to a communications system. In a specific example, an application of the power distribution connection apparatus may be shown in FIG. 5. One end of a power distribution connection apparatus 51 is connected to a −48 volt (V) busbar of a power supply system 52 of the communications system, and a tooth needle 3 at the other end of the power distribution connection apparatus 51 is plugged into a wire pressing frame (which is not shown in the figure) of a circuit breaker 53. The circuit breaker 53 is connected to a communications device 54, and therefore, it is implemented in the power supply system that multiple communications devices 54 and circuit breakers 53 are connected to the power supply system 52 by using the power distribution connection apparatus 51.

In the foregoing specific implementation manners, the objective, technical solutions, and benefits of the present invention are further described in detail. It should be understood that the foregoing descriptions are merely specific implementation manners of the present invention, but are not intended to limit the protection scope of the present invention. Any modification, equivalent replacement, or improvement made without departing from the spirit and principle of the present invention should fall within the protection scope of the present invention.

What is claimed is:

1. A power distribution connection apparatus, comprising:

a busbar comprising a first frame body and a second frame body, wherein one end of the first frame body is connected to one end of the second frame body;

a fastener comprising a fastening part and a first connecting part, wherein the fastening part is fitted outside the first frame body or the second frame body, and slides along the first frame body or the second frame body, and wherein a tooth needle mounting hole is on the first connecting part, and the first connecting part and the fastening part are connected on one side of the first frame body or the second frame body; and a tooth needle, wherein one end of the tooth needle is plugged inside the tooth needle mounting hole, a plugging depth is adjustable, and a side wall of the tooth needle is in contact with a side wall of the first frame body or the second frame body to form an electrical connection between the busbar and the tooth needle, and wherein the other end of the tooth needle is connected to an external circuit breaker to concatenate the circuit breaker to an external circuit by using the power distribution connection apparatus.

2. The apparatus according to claim 1, wherein the apparatus further comprises a secondary busbar, wherein the secondary busbar comprises a third frame body, and wherein one end of the third frame body is connected to an opposite end of the one end of the first frame body or an opposite end of the one end of the second frame body.

3. The apparatus according to claim 2, wherein the apparatus further comprises a splicer, wherein the splicer comprises two contact ends and a second connecting part, wherein the two contact ends are located at two corresponding ends of the second connecting part, and that one end of the third frame body is connected to the opposite end of the one end of the first frame body or the opposite end of the one end of the second frame body comprises the other end of the first frame body and an opposite end of the one end of the third frame body, or the opposite end of the one end of the second frame body and the one end of the third frame body are respectively abutted against two sides of the second connecting part to form the electrical connection between the busbar and the secondary busbar by using the second connecting part, connection points of the first frame body and the third frame body, or the second frame body and the third frame body are separately located between the two contact ends, and the connection between the busbar and the secondary busbar is fastened by using the splicer.

4. The apparatus according to claim 3, wherein the apparatus further comprises at least two busbars, and wherein the at least two busbars are connected by using the splicer.

5. The apparatus according to claim 3, wherein the second connecting part is made of a conducting material.

6. The apparatus according to claim 2, wherein the secondary busbar is made of a conducting material.

7. The apparatus according to claim 1, wherein the apparatus further comprises buckles at two ends of the fastener, and wherein the buckles are used for a fixed connection between the fastener and the busbar or between the fastener and the secondary busbar.

8. The apparatus according to claim 1, wherein the busbar is made of a conducting material.

9. The apparatus according to claim 1, wherein the fastener is a captive fastener.

10. A communications system, comprising:

a power distribution connection apparatus;

a power supply system;

a circuit breaker; and a communications device, wherein the power distribution connection apparatus comprises:

a busbar comprising a first frame body and a second frame body, wherein one end of the first frame body is connected to one end of the second frame body;

a fastener comprising a fastening part and a first connecting part, wherein the fastening part is fitted outside the first frame body or the second frame body, and slides along the first frame body or the second frame body, and wherein a tooth needle mounting hole is on the first connecting part, and the first connecting part and the fastening part are connected on one side of the first frame body or the second frame body; and a tooth needle, wherein one end of the tooth needle is plugged inside the tooth needle mounting hole, a plugging depth is adjustable, and a side wall of the tooth needle is in contact with a side wall of the first frame body or the second frame body to form an electrical connection between the busbar and the tooth needle, and wherein the other end of the tooth needle is connected to an external circuit breaker to concatenate the circuit breaker to an external circuit by using the power distribution connection apparatus, wherein one end of the power distribution connection apparatus is connected to a busbar of the power supply system, and the tooth needle at the other end of the power distribution connection apparatus is plugged into a wire pressing frame of the circuit breaker, and wherein the circuit breaker is connected to the communications device.

11. The system according to claim 10, wherein the apparatus further comprises a secondary busbar, and the secondary busbar comprises a third frame body, and one end of the third frame body is connected to an opposite end of the one end of the first frame body or an opposite end of the one end of the second frame body.

12. The system according to claim 11, wherein the apparatus further comprises a splicer, wherein the splicer comprises two contact ends and a second connecting part, wherein the two contact ends are located at two corresponding ends of the second connecting part, and that one end of the third frame body is connected to the opposite end of the one end of the first frame body or the opposite end of the one end of the second frame body comprises the other end of the first frame body and the opposite end of the one end of the third frame body, or the opposite end of the one end of the second frame body and the one end of the third frame body are respectively abutted against two sides of the second connecting part to form an electrical connection between the busbar and the secondary busbar by using the second connecting part, connection points of the first frame body and the third frame body, or the second frame body and the third frame body are separately located between the two contact ends, and the connection between the busbar and the secondary busbar is fastened by using the splicer.

13. The system according to claim 12, wherein the system further comprises at least two busbars, and wherein the at least two busbars are connected by using the splicer.

14. The system according to claim 12, wherein the second connecting part is made of a conducting material.

15. The system according to claim 11, wherein the secondary busbar is made of a conducting material.

16. The system according to claim 10, wherein there are also buckles at two ends of the fastener, and the buckles are used for a fixed connection between the fastener and the busbar or between the fastener and the secondary busbar.

17. The system according to claim 10, wherein the busbar is made of a conducting material.

18. The system according to claim 10, wherein the fastener is a captive fastener.

* * * * *